US010527392B2

(12) United States Patent
Herrmann et al.

(10) Patent No.: US 10,527,392 B2
(45) Date of Patent: Jan. 7, 2020

(54) TARGET

(71) Applicant: TACTICALTRIM E.K., Berlin (DE)

(72) Inventors: Marco Herrmann, Berlin (DE); Martin Keil, WE Haarlem (NL); Sebastian Stutte, Mahlow (DE)

(73) Assignee: TACTICAL TRIM E.K., Berlin (DE)

( * ) Notice: Subject to any disclaimer, the term of this patent is extended or adjusted under 35 U.S.C. 154(b) by 0 days.

(21) Appl. No.: 16/336,494

(22) PCT Filed: Sep. 27, 2016

(86) PCT No.: PCT/IB2016/001368
§ 371 (c)(1),
(2) Date: Mar. 26, 2019

(87) PCT Pub. No.: WO2018/060752
PCT Pub. Date: Apr. 5, 2018

(65) Prior Publication Data

US 2019/0339046 A1 Nov. 7, 2019

(51) Int. Cl.
*F41J 5/06* (2006.01)
*F41J 5/14* (2006.01)
*F41H 7/00* (2006.01)

(52) U.S. Cl.
CPC ..... *F41J 5/06* (2013.01); *F41H 7/005* (2013.01); *F41J 5/14* (2013.01)

(58) Field of Classification Search
CPC ..... F41J 5/06; F41J 5/14; F41H 7/005
USPC ..... 434/11
See application file for complete search history.

(56) References Cited

U.S. PATENT DOCUMENTS

2012/0074645 A1* 3/2012 Hodge ..... F41J 7/04 273/127 D
2013/0147117 A1 6/2013 Graham et al.
2014/0356817 A1* 12/2014 Brooks ..... F41A 33/00 434/19

FOREIGN PATENT DOCUMENTS

AU 2011035363 A1 3/2011
EP 2040025 A1 3/2009

OTHER PUBLICATIONS

International Search Report in PCT/IB2016/001368 dated Sep. 27, 2016.

(Continued)

*Primary Examiner* — Robert P Bullington
(74) *Attorney, Agent, or Firm* — Ralph E. Jocke; Colin P. Cochran; Walker & Jocke

(57) ABSTRACT

The exemplary arrangement relates to a target comprising at least one dummy depicting at least one part of the human body. According to the exemplary arrangement it is provided, that the dummy depicting at least one part of the human body comprises a plurality of sensors, which communicate with a sensor data evaluating apparatus (140) for the registration of the sensors. The sensor data evaluating apparatus determines, by mathematical correlation of points in time ($t_1$, $t_2$, $t_3$) corresponding to points of maximum pressure ($Pmax_1$, $Pmax_2$, $Pmax_3$) from sensor data of the plurality of sensors the point of entry ($\vec{T}$) and preferentially the trajectory of a projectile penetrating the dummy.

10 Claims, 8 Drawing Sheets

(56) References Cited

OTHER PUBLICATIONS

Written Opinion of International Search Authority in PCT/IB2016/001368 (in English).

* cited by examiner

TARGET

TECHNICAL FIELD

The exemplary arrangement concerns a target comprising at least one dummy depicting at least one part of the human body.

BACKGROUND

For training snipers of the police, the Bundeswehr (Armed Forces of Germany) and of special forces units it is known to employ targets in the form of a human silhouette. These are usually made of metal or cardboard and move on tracks or attached to wires through a simple scenario of a simulated crime scene. In the process, it is important for the sniper not to become distracted by the multitude of impressions from the simulated situation permitting the sniper to lock on and hit the target in a very short time. Among other uses, the silhouette depicting a human is used to train how the silhouette of the simulated target person has been hit since in a real situation, the task of a sniper can change within fractions of a second. If the situation initially only demands to stop a perpetrator, so that he cannot cause further damage or physical injury, it might become suddenly necessary within fractions of a second to fire the so called "final shot to save lives". This "aimed lethal use of firearms by police officers in terms of emergency relief" is to be used to avert threats to third parties if and only if no other means are available. To stop a perpetrator, aimed shots are tested, which are intended to preferably immobilize the target person without killing her or without injuring her through permanent and serious physical damage. In such a situation, it is necessary for the sniper to contemporaneously survey the overall situation, to lock on to the target person, and make the ethically difficult decision between a man stopping shot and, if applicable, a final shot to save lives all within fractions of a second. To practice this situation, metal or cardboard targets running through the simulated scenario at a shooting range are not sufficient. The metal or cardboard targets are predictable and are insufficient to cause effects other than surprise by sudden appearance or movement of the target.

To create simulated combat or crime situations for more realistic simulations, it is known to drive dummies mounted on an armoured small vehicle through a scenario. The small vehicle can be remotely controlled by the instructor and even autonomous systems that move through a simulated fighting scenario independently may be used. The autonomously moving dummies have a more realistic effect for the sniper from a distance, which is also helpful for the training of the emotional pressure in addition to the physical strain and the precise sighting and aiming.

With the international PCT-patent application WO 2011/035363 A1, a system for the training of armed personnel is revealed where dummies are mounted on small vehicles that are participants in a simulated fighting situation remotely controlled by a central control unit. These dummies are able to indicate to a suitable sensor system, if they have been hit or not. Within the US-application 2014/0356817 A1 a system according to the abovementioned WO 2011/035363 A1 is enhanced by the dummies moving on small vehicles through the simulated fighting scenario reacting to the fighting incidents by being remotely controlled by a central server. That way, it is possible to influence the actions of other dummies via the central server that is influencing the fighting activities.

The abovementioned dummies have the disadvantage in that they are less suitable for the initially mentioned training situation, namely to make the decision within fractions of a second. If the target person simulated by the dummy has to be stopped or even has to be killed, the abovementioned dummy arrangements are insufficient to replicate this fraction of a second decision making situation. Especially, the situation that takes place when the target person simulated by the dummy is hit and in response changes her behavior by reacting aggressively or in a panic-fueled manner, cannot be simulated. Further, it cannot be simulated that the person wounded by a bad hit might cause greater damages or personal injury than might have possibly happened before the hit. This highly dynamic and emotionally charged situation for all parties involved, including the sniper, can hardly be simulated and trained for with a dummy just driving around. Also, in hostage situations, where the target person simulated by the dummy protects herself with a hostage, cannot sufficiently be simulated by the abovementioned dummy arrangements. Another situation that is very difficult to train is when the target person simulated by the dummy drops her weapon for whatever reason. As soon as a target person is unarmed in real life, for instance the so called "final shot to save lives" is neither ethically justifiable nor legally permitted. So the short and possibly unexpected dropping of a weapon can change the entire fighting situation very suddenly and significantly.

SUMMARY

It is the role of exemplary arrangements to provide a target that permits direct conclusions about the quality of target hits.

This task is solved by the exemplary arrangement of a dummy depicting at least one part of the human body that comprises a plurality of sensors. The plurality of sensors communicate with a sensor data evaluating apparatus with circuitry operative for the registration and evaluation of the sensors' data. The sensor data evaluating apparatus determines, by mathematical correlation of points in time corresponding to points of maximum pressure from the respective sensor data of the plurality of sensors, the point of entry and preferentially the trajectory of a projectile penetrating the dummy. Further advantageous configurations are specified with in the dependent claims.

So according to the exemplary arrangement it is planned to classify the point of entry or hit by a projectile. To permit this classification sensors are available which permit the determination of the quality of hits. The point of entry and possibly the trajectory are counted among the quality of a hit. From historical field experience it is known, which kind of a hit on a hit person still permits which action. Thus it is known, that for instance a hit in the body area that did not pierce the lungs or the heart, permits the person hit—depending on her physique—to fire further aimed shots. A shot to the lung does not cause death directly, but the person hit is heavily restricted in her ability to still act. A shot to the heart causes unconsciousness almost immediately. In very special cases, for instance when the target person is holding a dead man's switch to allow her to detonate an explosive device after her own death by releasing the dead man's switch, it is necessary to kill the target person in a cramped position by a hit to the cerebellum. Such a hit would permit potential victims in the periphery of the target person to save themselves by flight before the dead man's switch should trigger.

Therefore, the plurality of sensors of the exemplary target dummy permit an evaluation of the hit, and by using a model, permit conclusions about which activities the target person can still perform after the detected hit.

According to the exemplary arrangement, sensors measure a pressure pulse within the dummy and determine the maximum of the pressure pulse with a high resolution in terms of time in the range of microseconds, or depending on the condition of the signal, the sensors determine the point in time of the first maximum of the pressure pulse. From the known three-dimensional location of the sensor and from the determined time, the point of entry on the dummy and, with a sufficient number of sensors, even the trajectory of the projectile can be determined.

During its life cycle, the dummy will be hit and penetrated by a plurality of projectiles. Depending on the individual hit, sensors can be hit as well. To avoid a hit in an electrical feed line of a sensor disabling the dummy, in some embodiments of the invention it is arranged that the plurality of sensors is communicating wirelessly with the sensor data evaluating apparatus. For instance by active or passive RFID transponder communication, communication by a generic near field communication with the sensor data evaluating apparatus, or by infrared communication or radio communication. It is provided for, that for infrared or radio communication or for communication by active transponder, each individual sensor of the plurality of sensors has its own battery in the form of a flat button cell. It is sufficient for a specific case of using active transponders, if the combination of sensor and transponder comprises a piezo element. The shot into the dummy with a projectile bearing a kinetic energy between 1 kJ and 50 kJ transfers a significant amount of energy onto the dummy by striking the dummy and causing a pressure wave to expand through the dummy. In an exemplary arrangement this pressure wave can be utilized by the piezo element as a short impulse of energy to charge a capacitor containing just enough energy to send out its own identification code at the maximum of the pressure pulse. The sent identification code is thereafter received by a receiver within the dummy and the exact time is determined. In this way, the receiver collects a number of RFID identifiers in a very short time with a registered point in time for each RFID identifier. The various pairs of individual RFID identifier and individual point in time are suitable for the characterization and computation of the quality of the hit.

To make the dummy operational again as quickly as possible after a training mission in which a sensor has been hit, it is provided for that the plurality of sensors are sticking in the exterior skin of the dummy. The plurality of sensors expose as little surface area as possible to a projectile. To achieve this, it is provided for in an example embodiment that the sensors are essentially designed as a flat shape or disk-shaped and are aligned radially in relation of a body axis of the dummy depicting at least one part of the human body. This implies that the plurality of sensors are sticking with the small silhouette of the edge width of the flat shape or disc-shaped sensor extending radially into a wall of the exterior skin of the dummy. As a result sensors are put in slots and only expose their smallest edge width silhouette to the outside.

Further, in the example arrangement, the plurality of sensors are identical among each other and are preconfigured by color and shape for an easy exchange. Therefore, a preconfigured sensor is only applicable at a point of the dummy pre-determined for the pre-configured sensor.

Principally it is sufficient for a three-dimensional determination of the point of entry and the trajectory, if there are only three sensors within a small area of the dummy surface, within which the different sensors are located nearly at the same level. From the data of the three sensors, the point of entry can be determined precisely within the local level. If four sensors are employed, it is also possible depending on the placement of the sensors, to deduce an approximate trajectory of the projectile. For the placement of the sensors, it is helpful if each location for placement has a predetermined shape of an insertion slot corresponding to the flat shaped or disc-shaped sensor and is preferably color-marked. For the quick change of the possibly hit sensors, it is sufficient to exchange sensors of for example type a, type b, type c or type d, which are differentiated by their RFIDs. In the apparatus for the evaluation of the sensor data, RFID identification codes are stored correspondingly, whereby the three-dimensional location of each RFID type, identifiable by the code, is stored in the apparatus.

However, the quality of determination of the point of entry and the trajectory has some obstacles with a complex geometric figure in the shape of a human torso that have to be overcome. Initially the expansion of the three-dimensional pressure wave follows the shape of the dummy. In case of the sensors being far apart from each other and being arranged for instance at the head and the abdomen of the dummy, it is not sufficient for the determination of the exact point of entry and trajectory to assume linear runtimes for the pressure wave. The pressure wave is reflected repeatedly in the interior of the dummy and so pressure wave echos of different orders (change by one order per reflexion) form. Consequently, it becomes difficult to filter the pressure maximum that is significant for the evaluation of the hit from the pressure wave echoes. Therefore, it is useful to arrange the sensors in groups that are located close to each other so that the initial pressure wave reaches all sensors of a group prior to an echo of the pressure wave reaching a sensor of the group. To circumvent the problem of the echo it has proven advantageous in some arrangements if the dummy is filled with a gel. The gel, preferably with the consistency of paste-like lubricating grease or the consistency of undissolved soft soap, brings several benefits. First, the absorption of kinetic energy from the projectile by the dummy is relatively high. In this case where the sensors are supplied with energy only by a piezo element, the gel filling results in a high energy transfer.

The high energy transfer also results in a reliable detection of a hit and the ability to distinguish this from, for instance, a violent collision of the dummy with another dummy or an obstacle. Additionally, the gel with the said consistency greatly dampens and helps to mask transversal waves against longitudinal waves. Since transversal waves have a different propagation speed within a three-dimensional medium than longitudinal waves, a dispersion of the pressure wave occurs within an un-dampened medium, like for instance air without gel filling, which complicates the signal evaluation. Similar to lightning during a thunderstorm, the dispersion leads to a signal with several pressure maxima in succession, which reach the sensor repeatedly as pressure maximum, similar to an atmospheric thunder. Also, echos are suppressed by the gel allowing the pressure maximum of the first pressure wave to be determined better. Finally, the gel filling leads to a density of the dummy that is similar to that of an actual human. Thus, the mechanical effect of the kinetic energy transferred to the dummy appears more real during observed events. Also, the sound of the projectile hit is similar to a real hit. Last of all, the gel has the tendency to close itself after a hit. That way, the dummy can be hit several times without losing its function. The gel can consist of grease, of a soft wax that has been further softened with a solvent where appropriate, of soft soap, but also of an acrylate gel or of gelatin. Finally, weakly crosslinked organic polymers welled in water are possible as gel filling as well.

The condition of the outer skin also referred to as the exterior skin, of the dummy has an influence on the measuring result of the sensors and the apparatus for the evaluation of the sensor data belonging to it. Additionally, the condition of the outer skin of the dummy has an influence on the duration of the life cycle of the dummy. It would be ideal if the dummy would close itself completely again after a hit. One can get close to this goal, by having the outer skin or exterior skin consist of polyurethane foam, which is compacted at the external surface to a leathery or rubbery consistency and has a hardness between soft rubber and hard rubber. It is also provided for in the exemplary embodiment that the dummy itself consists of polyurethane foam, which is compacted at the outer surface so that the external surface has a rubbery to leathery quality, whereby the locations for the placement of the sensors are buttonhole shape slots in the outer external surface or exterior skin of the dummy, whose inner shapes correspond to the outer shape of a pre-configured sensor, whereby the buttonhole shape slots have preferably a color marking. When the polyurethane foam is penetrated by the projectile, the leathery to rubbery skin that covers the foam seems to close itself after entry of the projectile. However, the polyurethane foam remains severed at the location of entry, but the foam underneath the leathery to rubbery skin will be mechanically closed again by the elastic foam.

To train a special situation, for instance where the target person represented by the dummy drops her weapon, no matter for what reason, it is provided in the exemplary embodiment an arm of the dummy depicting at least one part of the human body. The exemplary arm comprises a fixture for the mounting or holding of objects, like for example a dummy weapon, approximately in the area of the hand mounted to the arm. The fixture for the mounting or holding of objects can drop an object previously held up by remote triggering. Further, the fixture for the mounting or holding of objects can be controlled remotely. So it is provided, that the arm of the dummy can hold a weapon in the hand or can carry a weapon in the crook of the arm. During a fight situation with the dummy, it can be set-up then that the dummy drops the weapon randomly by a controlled program or otherwise by remote triggering by command of the training leader. This situation happens in reality as well. Even though the target person represented by the dummy does not reveal outwardly that it surrenders or gives up, it continues to act. It is possible that the dropped weapon drops only accidentally. In this situation a shot aiming to kill would legally and ethically not be justifiable anymore. To train the sniper to recognize this situation and to aim and to observe the total situation can now be accomplished with such a dummy conforming to the exemplary arrangement.

In the exemplary embodiment, the dummy s may not only be able to hold or drop a dummy weapon. Beyond that, it is provided in the exemplary embodiment that an arm of the dummy depicting at least one part of the human body is movably motor driven by a drive. The drive can be controlled remotely. Due to the raised arm, an aiming at the sniper by the dummy can be simulated. To avoid damage that the drive of the arm takes by firing at the dummy with projectiles, it can be provided for that the arm is driven by a rod gearing mechanism or by a rope pull from underneath the dummy shaped as a torso.

Besides the simulation of a dropped weapon or of an arm lifted for aiming and/or shooting, an additional difficult situation for the sniper can be simulated with a further exemplary embodiment. This situation is when the target person represented by the dummy uses a hostage as a human shield. In the simplest case, it can be provided that an additional second dummy depicting at least one part of the human body, in the form of a silhouette of a target, is positioned related to the first dummy behind or in front of the first dummy on the target. The additional dummy is movably motor driven by a drive including at least one of a lever or by a scissor gear so that the first and the second dummy can either overlap or be positioned offset to each other. The drive for the additional dummy can be controlled remotely.

When the dummy is mobile as well, the drive of the dummy gains a special importance. The dummy can be mounted on an armored small vehicle, be moved on two robotic legs running autonomously or be set on two wheels arranged on one axle (single-axle vehicle), whereby an electronic straightening apparatus keeps the dummy always in balance. So it is provided in the exemplary embodiment, that the apparatus for unbound movement across a terrain is a three or four-wheeled armored small vehicle, an armored vehicle (single-axle vehicle) with two wheels arranged parallel on one axle with a straightening apparatus or an apparatus resembling two human legs, and wherein the apparatus with the two legs performs humanoid motion for movement. The different drives have different advantages and disadvantages. It is advantageous with the armored small vehicle driving on three or four wheels that it can hold a battery with a high charge and needs comparatively little energy for movement. However, such a dummy is not very maneuverable afield and cannot drive over small obstacles easily anymore. In closed buildings such a small vehicle is not maneuverable enough. The autonomous, robotic legs are extremely all-terrain and there are controllers in existence already, that are able to move such robotic legs almost as fast as the real human and to move almost as stable. However, at the date of this application, this technology is still very expensive and vulnerable and hard to armor, so that ricochets or unwanted hits in the leg section of the dummy could destroy the dummy. Finally the single-axle vehicle is possible as a drive, which is very maneuverable and needs little space. It is disadvantageous with this drive that the dummy sways back and forth when turning, which leads to an unnatural movement pattern of the dummy.

In the exemplary embodiment, the dummy is provided as a movable target. A control unit for the target controls the unbound movement across a terrain, and/or the arm of the dummy, and/or the fixture for the mounting or holding of objects. The exemplary control unit is operative to cause the dummy to perform a pre-set repertoire of motion patterns, which externally conform to the body language of typical emotions during a combat situation. For instance the pre-set repertoire of motion patterns include a resting position to remain unrecognized, a position of panic, a position of aggression or a position of flight. The exemplary control unit is connected to additional movable targets wirelessly through a central command device. The communication connection is completed by at least one of client-server communication or via direct peer-to-peer communication. Wherein in the case of a hit by a projectile with predetermined parameters, like for instance a computed lethal shot, a computed man-stopping shot, a computed shot lethal with delay, the central control unit communicates the result of its own computations to the additional movable targets identical or similar in construction, and the additional movable targets show a changed motion pattern in response to the communication of the result by the control unit.

This kind of interaction by different movable targets identical in construction or similar in construction makes it possible to train a situation that is apparently quiet on the outside but in reality, is very fast and dynamically variable. Thus, it can be trained for instance a situation that in the case of a shot, panic erupts among a group of dummies. Previously calm appearing dummies aimed for by the sniper suddenly move, lose weapons, others raise their weapons and/or change their direction of movement. In such a situation, target persons portrayed as dummies may also peek out from behind a hostage creating a demanding training situation for the trainee that can compete with real situations.

BRIEF DESCRIPTION OF THE DRAWINGS

The exemplary embodiment will be explained by means of the following illustrations. They show.

DETAILED DESCRIPTION

Figure 1:
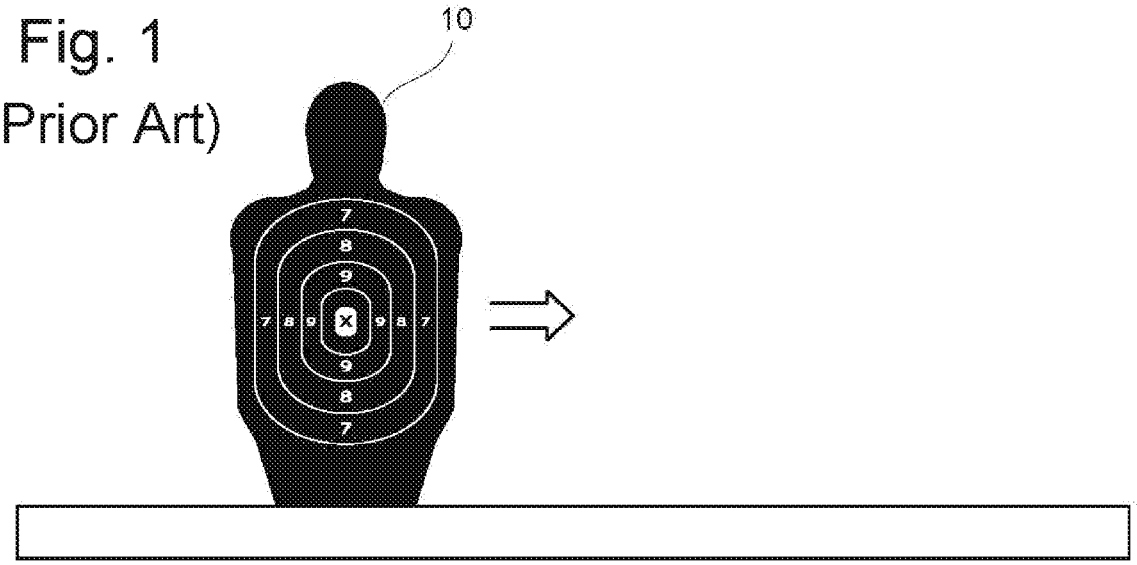
Fig. 1 (Prior Art)
FIG. 1 a movable target from state-of-the-art.

In FIG. 1 a movable target 10 from the state-of-the-art is displayed. The movable target 10 is taking its path from left to right as a metal or cardboard target with a silhouette of a human and in doing so can come up (pop up) from the back or can fall down to the back. For a sniper, who has to train in dynamic or highly dynamic situations, this kind of movable target is predictable, boring and offer a surprise effect only by coming up and falling down to the back.

Figure 2:
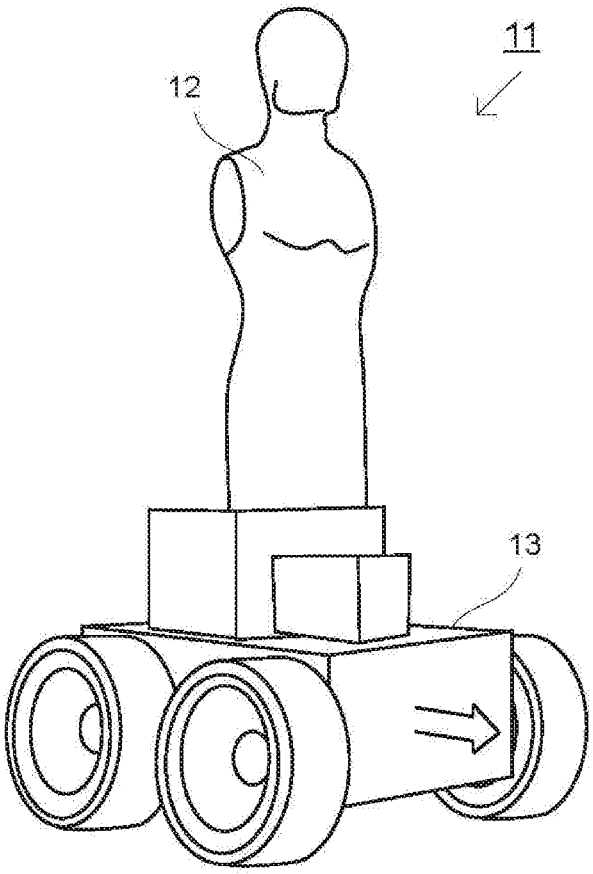
Fig. 2 (Prior Art)
FIG. 2 another movable target from state-of-the-art.

In FIG. 2 a movable target 11 from the state-of-the-art is displayed. The movable target 11 is mounted as a three-dimensional torso 12 on an armored small vehicle. The armored small vehicle 13 is remotely controllable and is controlled by a central computer that can also control complex patterns of movement with a dynamic adjustment to external events with an appropriate computer program. The torso 12 has sensors not shown here, which can detect a hit qualitatively, detecting if it was hit or not. The category or classification of the hit cannot be analyzed in real time or close to real time.

Figure 3:
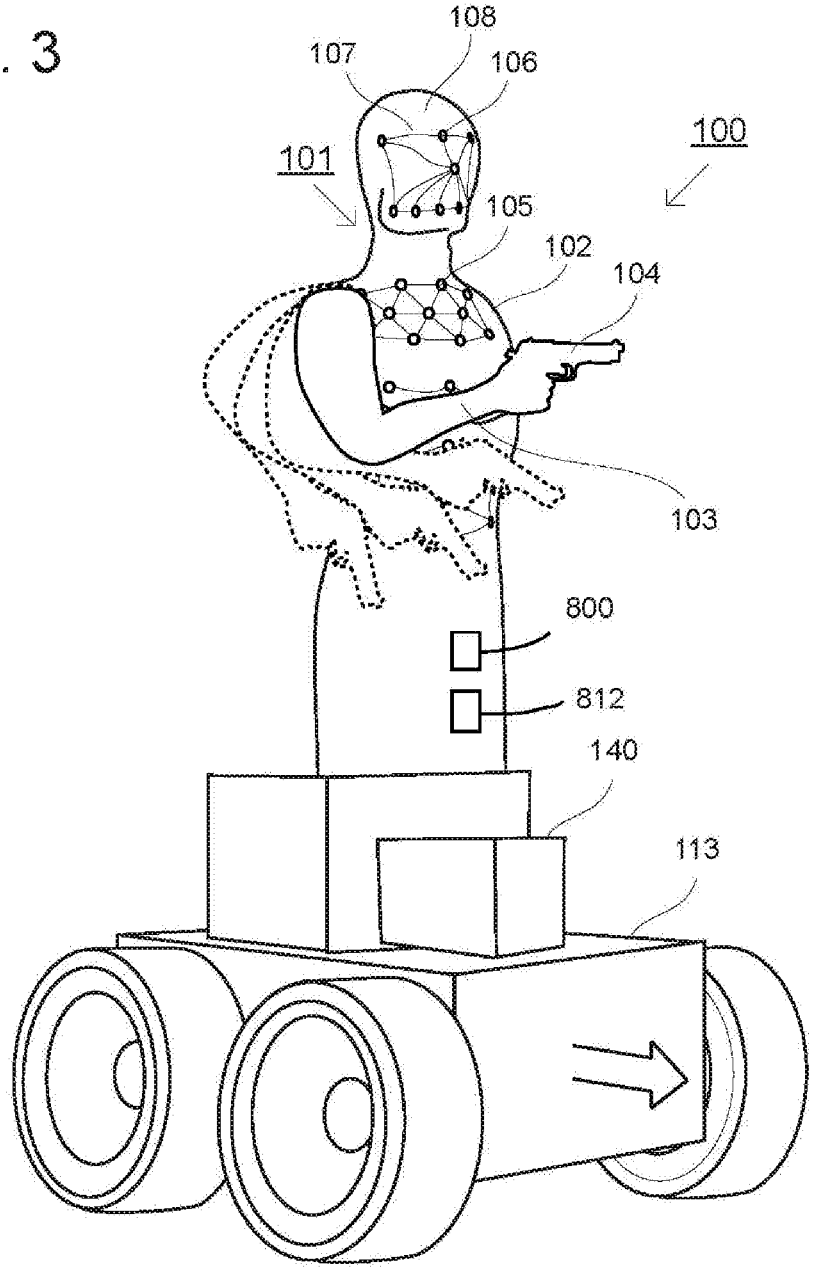
FIG. 3 a movable target according to the exemplary embodiment.

FIG. 3 eventually shows a first design variant of a movable target 100 according to an exemplary arrangement. Movable target 100 is structured as a torso 102 with a head 108 placed on top of the torso mounted on an armored small vehicle 113. Armored small vehicle 113 is also referred to as device 110. As a special feature, the mounted torso 102 exhibits a movable right arm 103 holding a dummy weapon 104 with the hand. The arm 103 of the dummy 101 is movably motor driven by a drive 800. The drive 800 can be controlled remotely. By a programmed rising of the hand with the weapon, this movable target can simulate an attack by a target person, to which the sniper has to react adequately. In further design variants of the movable target according to the exemplary embodiment it is provided for that the arm 103 can shoot up to simulate a surrendering target person. Besides the arm 103, there are sensors 106 in the face area and sensors 105 in the chest area of the torso 102 which are outlined here as a grid 107 for clarification of the geometric cross-linking between them. By means of sensors 105 and 106, which detect primarily a pressure pulse of a pressure wave, the point of entry and when, applicable, the trajectory of the projectile hitting the movable target 100 are determined. The number of sensors 105 and 106 can be 3 to 4 but also 10 or 20 and more depending on the demanded precision of the analysis of the point of entry and the trajectory. The more sensors 105 and 106 that are installed, the shorter is the life cycle of the dummy 101 due to a probable hit by a projectile. Dummy 101 is also referred to as the first dummy.

Figure 4:
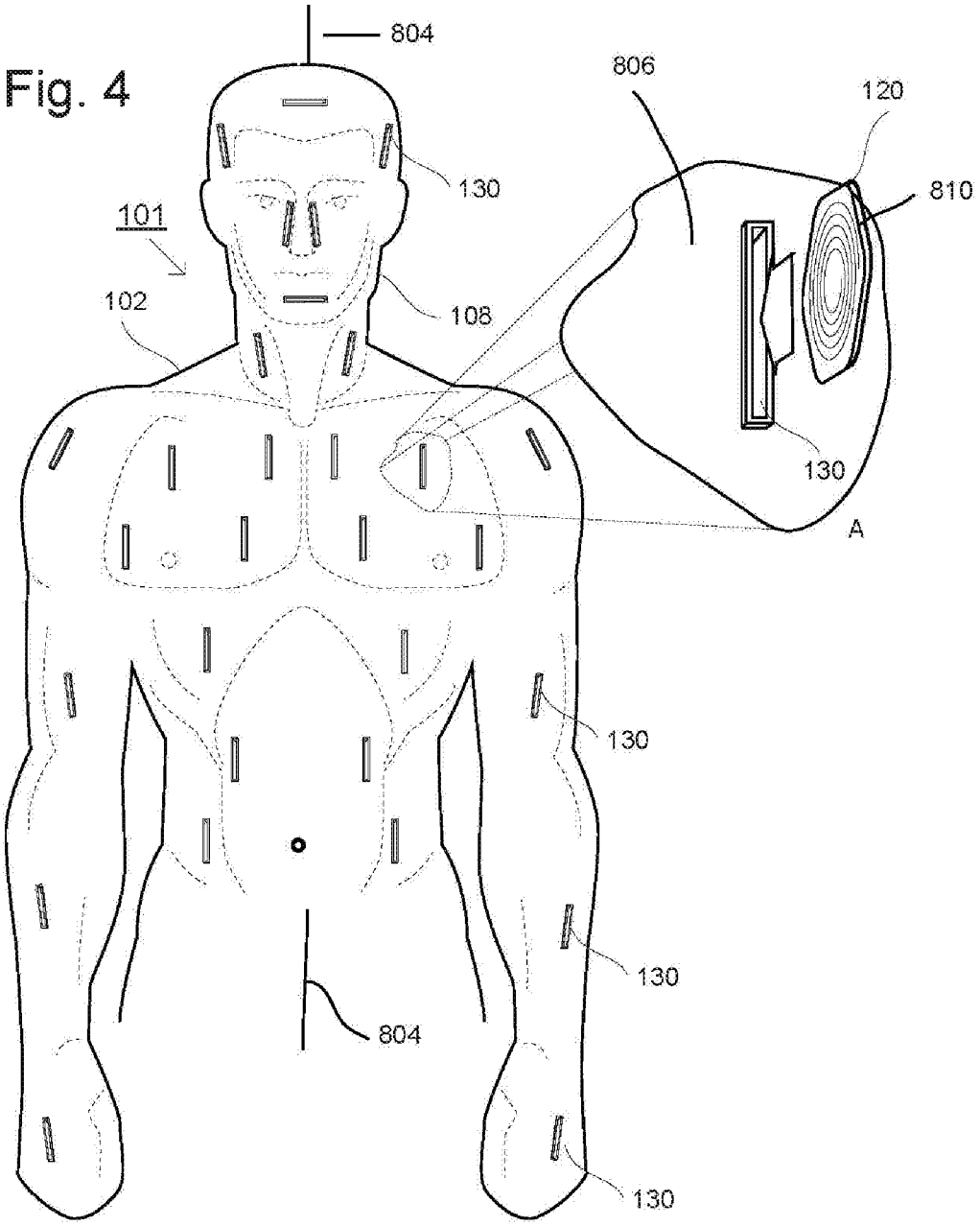
FIG. 4 the torso of the movable target according to the an exemplary embodiment showing an arrangement of the placement of individual sensors, FIG. 4*a* sensors with different shapes for the use at predetermined sections of the torso from FIG. 4, FIG. 5 display of a sagittal section through the torso, FIG. 6 a torso opened by a sagittal section with folded out torso halves, FIG. 6*a* outlining of a point of entry into a torso, displayed on one of the torso halves, FIG. 6*b* display of pressure pulse signals of different sensors attached to the torso, FIG. 6*c* drawing for clarification of the computation of the point of entry from sensor data, FIG. 7 display of a movable target on an armored small vehicle, FIG. 8 display of a movable target on autonomously walking, robotic legs, FIG. 9 display of a movable target on a single-axle vehicle with electronic straightening apparatus, FIG. 10 display of a movable target with a second dummy displayed as a hostage, FIG. 11 display of a movable target with a second dummy displayed as a hostage, the target person displayed as a dummy peeking out behind the hostage, FIG. 12 display of a movable target with a second dummy displayed as a hostage, the target person displayed as a dummy, that is holding a weapon, FIG. 13 display of a movable target with a second dummy displayed as a hostage, the target person displayed as a dummy, that has dropped a weapon.
Figure 6:
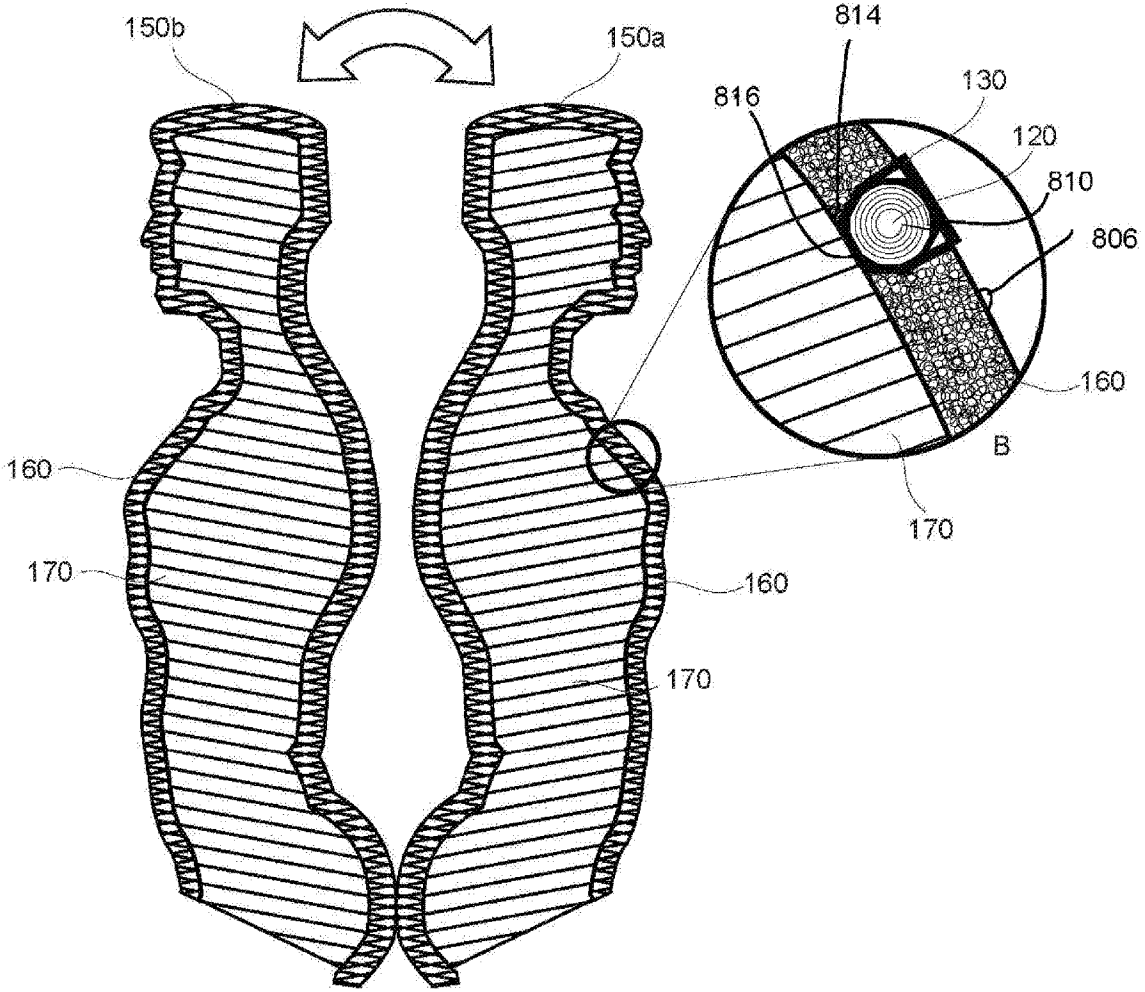

In FIG. 4 exemplary positions of the plurality of sensors within the dummy 101 consisting of torso 102 and head 108 are displayed. The plurality of sensors 120, 121, 122 and 123 are individualized by their shape and color scheme as to which the sensors can be inserted into the dummy 101. It is provided for, that sensors of a predetermined type with a predetermined identification number can only be inserted into positively corresponding butthole shape slots 130 as is demonstrated in detail enlargement A. The buttonhole shape slots 130 have an inner shape 814 within the side 160 of torso 102 of the dummy 101. The inner shape 814 of the buttonhole shape slots 130 is shown in FIG. 6. The inner shape 814 corresponds to an outer shape 816 of the preconfigured sensor, shown in FIG. 6. Thereby the sensors 120, 121, 122 and 123 can be battery-powered sensors, which are designed as active transponders. It is also possible, that the sensors 120, 121, 122 and 123 are equipped with an apparatus 150 for infrared communication and may communicate by infrared impulse with a sensor data analyzing apparatus 140 such as computer circuitry. Finally, the sensors can also comprise an apparatus for radio communication by radio waves with the data analyzing apparatus 140, whereby a BlueTooth®-set-up would be possible for a protocol. In the exemplary embodiment it can be provided that the sensors 120, 121, 122 and 123 comprise a piezo element 135 that absorbs the kinetic energy of a pressure wave caused by a projectile 200 entering into the dummy 101. The piezo crystal converts the pressure pulse into a short voltage pulse that is sufficient to charge a condenser within the electronics of the sensor 120, 121, 122 and 123. The stored electrical energy within the condenser will then be sufficient for a very short period of time, that the sensor 120, 121, 122 and 123 sends its identification number at the moment of measuring the pressure pulse. This identification number will then be received by the data analyzing apparatus 140. The precise time with a higher resolution than 1 μs of receipt of the radio or infrared message together with the identification number, that has been allocated a three-dimensional location internally, will be stored temporarily in the data analyzing apparatus 140.

The placement of the sensors, which should include at least four sensors, should be in a way that the desired target regions of the human body are covered by a swarm of sensors belonging together. The swarm belonging together has the capacity each to detect a pressure wave of the zeroth order (no reflection at a phase interface), before an echo by reflection of the pressure wave reaches the respective sensor again.

In order for no damage of the sensors to occur while under fire, the sensors 120, 121, 122 and 123 are manufactured as flat disks and inserted radially relative to the body axis 804, into an exterior or outer skin 806 of a wall 160 of the torso 102 and the head 108. In this exemplary arrangement the sensors 120, 121, 122, and 123 have a small edge width silhouette 810 that extends radially into the exterior skin or outer surface skin wall 160. This is shown in FIG. 6, enlargement B. Because of the radial arrangement, the sensors manufactured as flat disks are rarely hit while under ordinary fire. Only in the case of grazing shots, a sensor could be hit by a projectile. In this case, the sensor would have to be replaced by a new sensor with an identical identification number or with a known new identification number.

Figure 4A:
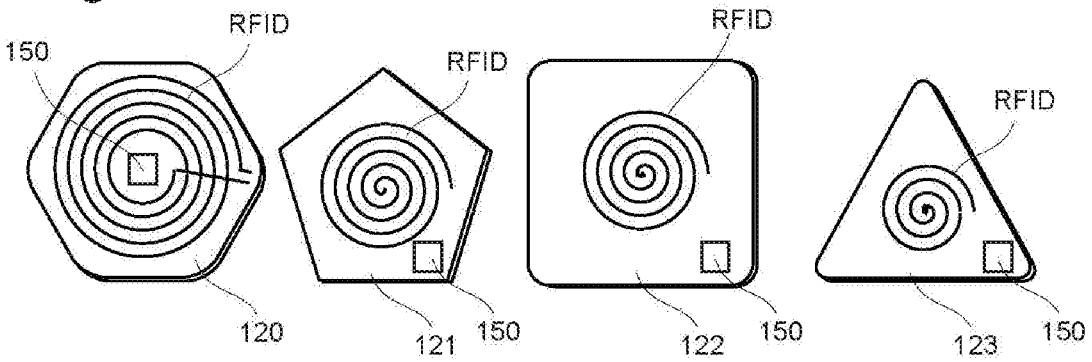

In FIG. 4*a* differently shaped sensors 120, 121, 122 and 123 are shown, that are shaped similarly as the components of an insertion game. The diverse design helps the personnel, which are possibly under time pressure and emotional stress in a training situation, not to confuse the sensors. With a color encoding, the allocation of pre-fabricated sensors to predetermined identification numbers can be even further facilitated.

Figure 5:
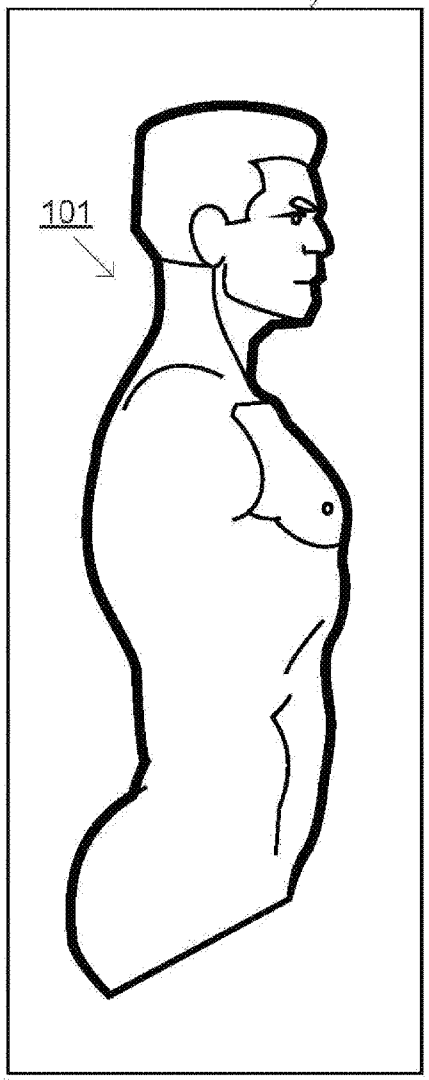

In FIG. 5 the sagittal section 150 through the dummy 101 consisting of torso 102 and head 108 is shown. A dummy 101 cut open in this section plane presents the picture displayed in FIG. 6 when both dummy halves 150*a* and 150*b* are unfolded. Torso 102 as well as head 108 has a side strength dimension of approx. 3 cm to approx. 10 cm. For instance, the side 160 of torso 102 and head 108 are made of polyurethane foam or foamed vinyl natural rubber that comprises a rubbery to leathery consistency in form at the phase interface due to heat treatment during casting. Thereby, the phase interface of the dummy 101 has a side strength dimension of approximately 0.3 mm to 1.5 mm. Between both phase interfaces, the polyurethane foam or the vinyl natural rubber (here as exemplary, elastic foams) is developed by appropriate softening agents as a rather tough and elastic foam material. For a number of advantages, the dummy 101 in a special version is filled with a gel 170 that has the consistency of paste-like lubricating grease or the consistency of undissolved soft soap. Thereby the gel can actually also consist of industrial mineral grease, actually of soft soap, of acrylate gel welled in water or of weakly crosslinked organic polymers welled in water or solvents when appropriate. Also soft wax is suitable when softened with solvents, mineral grease or oil. The gel filling leads to a higher energy intake of the dummy 101 from the projectile, permits a more precise detection of the pressure wave by the sensors, permits the masking of transversal waves and longitudinal waves, leads to a stronger dampening of the pressure wave, and also leads to a more realistic picture of the movement of the dummy 101 when hit by the projectile. Finally the sound of the hit becomes more realistic. In detail enlargement B it is shown, how a sensor 120 sticks in a slot within the side of the dummy 101 assembled from torso 102 and head 108. Thereby the sensor 120 has been absorbed into the tough and elastic foam material of the dummy 101.

Figure 6B:
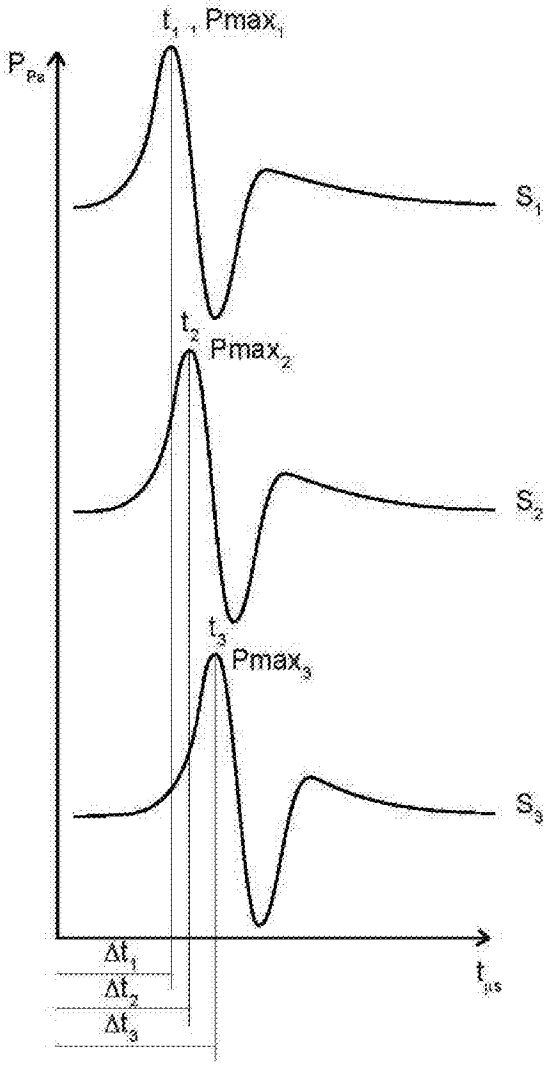
Figure 6A:
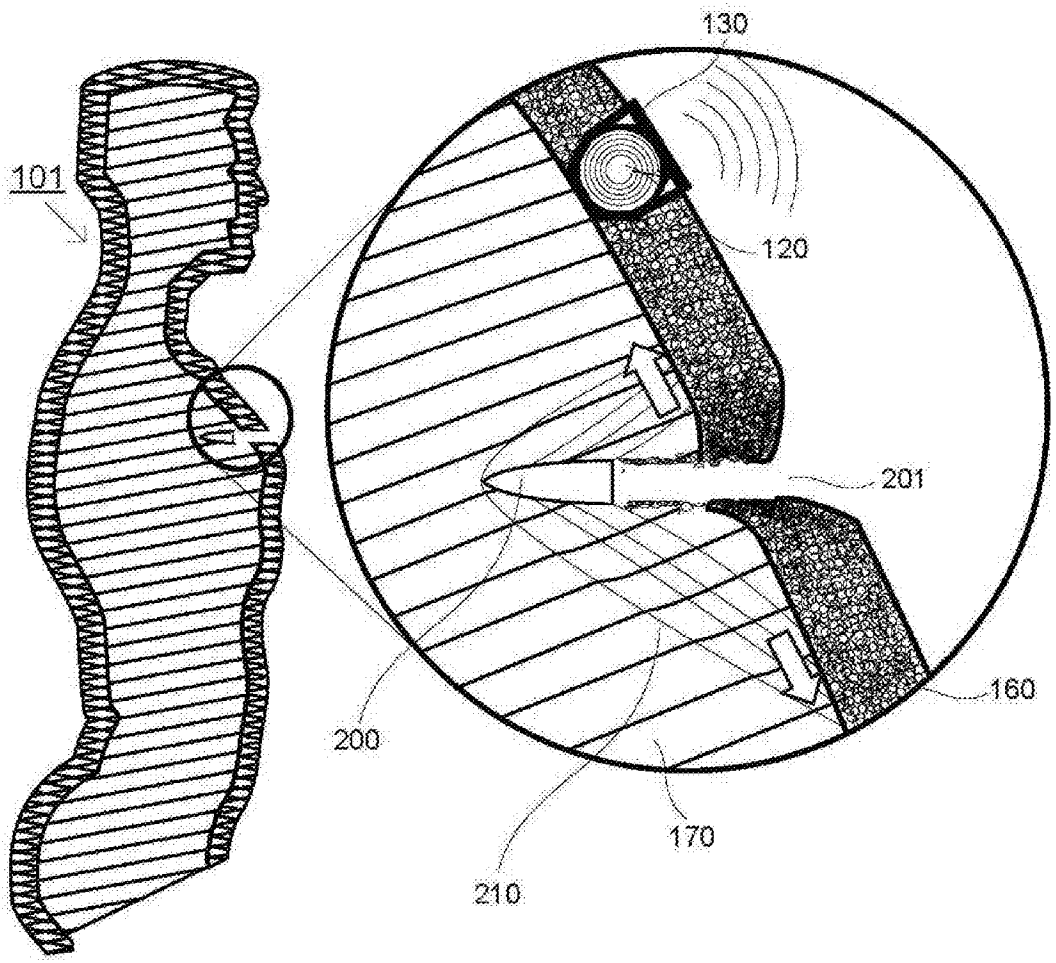

A hit of the dummy 101 by a projectile 200 is displayed in FIG. 6*a*. In the detail enlargement of 6*a* it is shown how the projectile 200 pierces the side 160 of the dummy 101 consisting for instance of polyurethane foam and in doing so pierces the gel filling as well. The piercing by the projectile 200 forms a tunnel 201 in the moment of the hit. However, this closes again a short time after the hit. Within the gel 170, a pressure wave 210 expands at the piercing by projectile 200, which expands circular in the direction of the arrow (the directions of the arrows indicate two radial directions in relation to the projectile trajectory). The pressure wave 210 around the trajectory of the projectile 200 moving along forms a cone around the trajectory probably determined by the ballistics of the projectile and probably bent as well and hits the different sensors 120, 121, 122, 123 at different times. At the moment of the detection of the pressure impulse, the sensor 120 sends a signal to data analyzing apparatus 140. From the different points in time when the pressure wave 210 is detected at the different sensors 120, 121, 122, 123 with known set-up and therefore known location, the point of entry can be determined by triangulation within the data analyzing apparatus 140.

For detection of the point of entry of the projectile on dummy 101, in FIG. 6*b* the pressure pulse diagram picturing pressure P in Pa and the time t in μs, for the three sensors $S_1$, $S_2$ and $S_3$ is shown. The three sensors $S_1$, $S_2$ and $S_3$ all register at a slightly different point in time $t_1$, $t_2$ and $t_3$ a very similar pressure pulse signal $Pmax_1$, $Pmax_2$ and $Pmax_3$. The various slightly different points in time $t_1$, $t_2$ and $t_3$ have to be traced back to the different running times of the pressure wave expanding through the gel. It should be indicated at this point, that a detection also works with an air filled dummy 101 and with a dummy 101 made of full-foam material. It is important to keep the number of phase interfaces with a large difference in density low.

A totally homogeneous material would be ideal or the existence of material boundaries with a very large difference in damping performance.

Figure 6C:
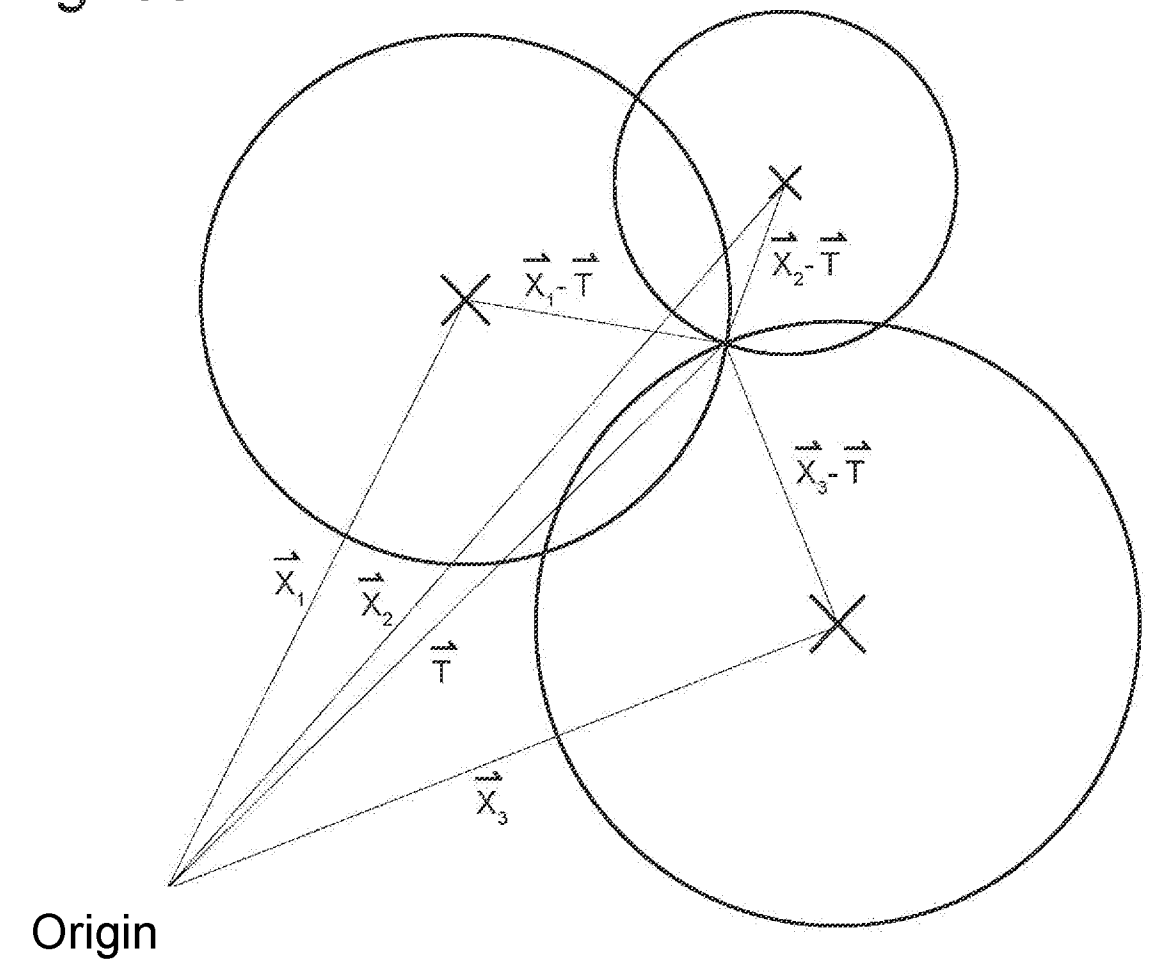

For computation of the point of entry $\vec{T}$ in FIG. 6*c* as vector with the coordinates ($x_T$, $y_T$, $z_T$) the following equation is solved:

$$(\vec{X}_1+\vec{\vartheta}*\Delta t_1)-(\vec{X}_2+\vec{\vartheta}*\Delta t_2)=(\vec{X}_3+\vec{\vartheta}*\Delta t_3) \quad (1)$$

whereby $\vec{X}_1$ stands for the fixed location of sensor 1, $\vec{X}_2$ stands for the fixed location of sensor 2, $\vec{X}_3$ stands for the fixed location of sensor 3, $\vec{\vartheta}$ stands for the velocity of sound in vectorial form in the gel or in the filling of the dummy, $\Delta t_1$ stands for $t_1-t_0$, the time difference between point in time $t_0$ of the point of entry and point in time $t_1$ of the arrival of the pressure wave at sensor 1, $\Delta t_2$ stands for $t_2-t_0$, the time difference between point in time $t_0$ of the point of entry and point in time $t_2$ of the arrival of the pressure wave at sensor 2, $\Delta t_3$ stands for $t_3-t_0$, the time difference between point in time $t_0$ of the point of entry and point in time $t_3$ of the arrival of the pressure wave at sensor 3, whereby $t_0$, which is the exact time of the point of entry and also the direction of the unit vector in $\vec{\vartheta}$ in are initially unknown.

Solving the equation (1) for $t_0$ results in:

$$t_0=-[\vec{X}_1-\vec{X}_2-\vec{X}_3+|\vec{\vartheta}|*(t_1-t_2-t_3)]/|\vec{\vartheta}| \quad (2)$$

By replacing the unknown to with the result from (2) and solving for equation 1, the point of entry $\vec{T}$ can be found because there is just one location $\vec{T}$ where the equation (1) is satisfied. When solving the equation (1), the respective directional component of the unit vector $\vec{\vartheta}$ has to be varied for each incidence within the equation. This still simple process is suitable for the detection of a vertical hit on a flat location of the dummy neighboring to the sensors $S_1$, $S_2$ and $S_3$. Already with an oblique point of entry it has to be considered, that the pressure wave cone around the projectile changes with the direction of the trajectory. To compute the location of an oblique point of entry correctly, sensor data of further sensors are necessary. In this case during evaluation, the geometric form and the alignment of the pressure wave cone has to be observed, which depending on the angle of the point of entry at an identic location can lead to different chronological sequences of the impact of the pressure wave at one sensor each. If there is a plurality of sensor data, the location of the point of entry and the trajectory can be computed under the assumption of a linear expansion of the projectile within the dummy. Depending on the complexity of the calculation model it is even possible, like with the evaluation of the signals of an echo sounder for a structural survey of the ocean floor, to determine precise data on the point of entry of the projectile, direction of trajectory of the projectile, and with the corresponding cost, even the alignment of the projectile when the projectile precesses during impact or ricochets.

Figure 7:
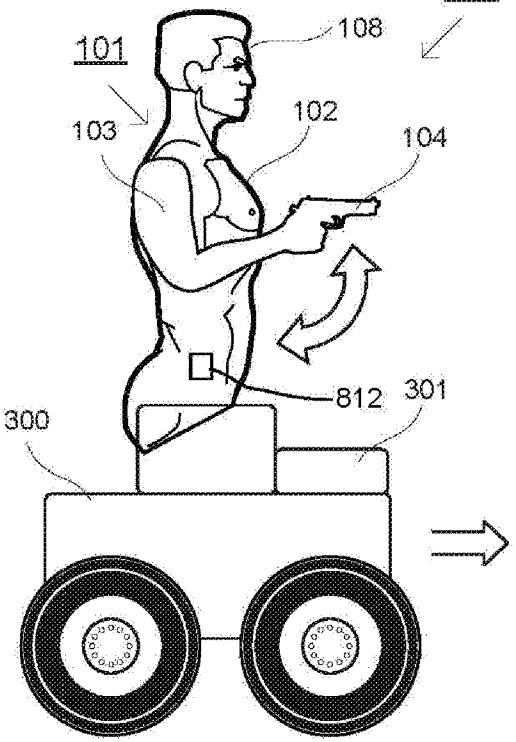

In FIG. 7 the dummy 101 consisting of torso 102 with a head 108 is mounted on an armored small vehicle 300 presented as movable target 100. Armored small vehicle 300 is also referred to as device 300. The dummy comprises a movable right arm 103 holding a dummy weapon 104. This version of the movable target is well suited for flat terrain and has the advantage that a battery with a high capacity can be carried along on board of the movable target. For the evaluation of the sensor data, a sensor data analyzing apparatus 301 is on board. Armored small vehicle 300, and device 300, in other embodiments may have only 3 wheels, instead of 4. Movable target 100 in the exemplary embodiment shown in FIG. 7 includes a control unit 812. Control unit 812 is located within the target and controls the unbound movement across a terrain, and/or the arm of the dummy, and/or the fixture for the mounting of objects.

Figure 8:
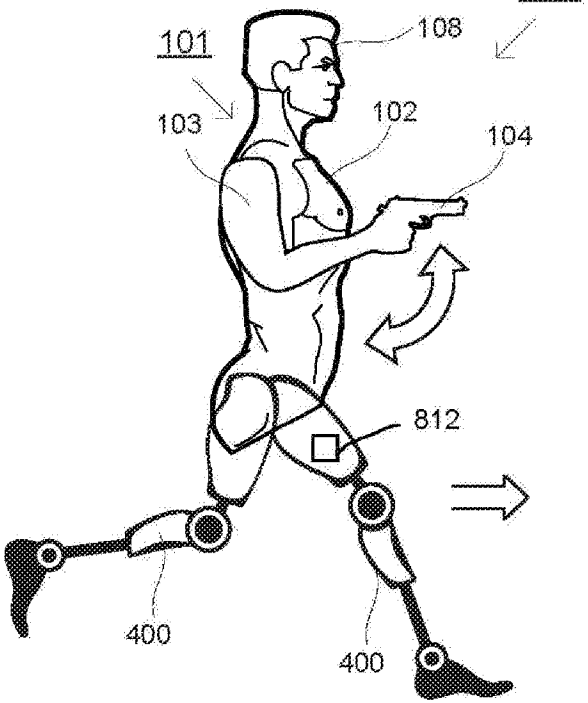

In FIG. 8 the dummy 101 consisting of torso 102 and head 108 is displayed as a movable target 100' on autonomously running robotic legs 400, wherein the dummy comprises a movable right arm 103 holding a dummy weapon 104. Autonomously running robotic legs 400 are also referred to as device 400. The advantage of this version of the movable target is the extreme maneuverability and cross-country capability. However, the disadvantage of the use of this technology is the still quite high vulnerability of such robotic legs 400, which can easily be damaged during exercises including fire exercises. Although armoring is possible, it decreases the agility of the robotic legs. Movable target 100, in this exemplary embodiment in FIG. 8 includes control unit 812.

Figure 9:
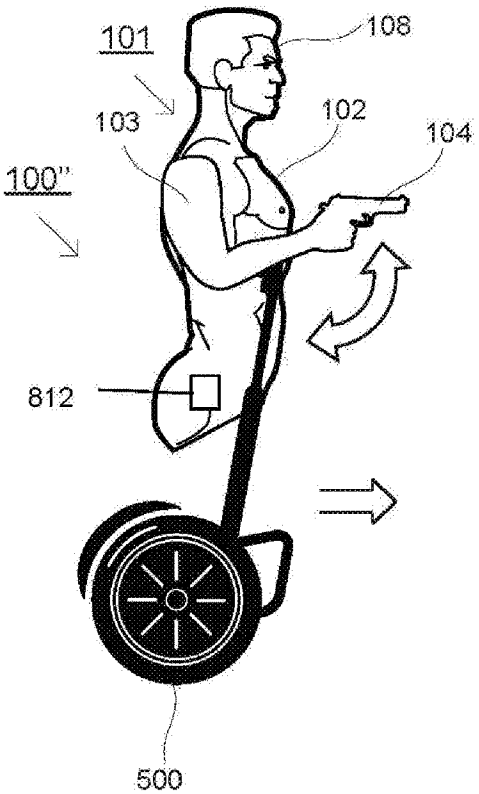

In FIG. 9 an example of the dummy 101 is displayed on a single-axle vehicle 500 as movable target 100, wherein the dummy comprises a movable right arm 103 holding a dummy weapon 104. Single-axle vehicle 500 is also referred to as device 500. The single-axle vehicle 500 has a straightening apparatus not described in more detail and as such, keeps the dummy 101 consisting of torso 102 and head 108 always in balance. Such vehicles are readily available on the date of this registration and these single-axle vehicles 500 have a very high maneuverability, which makes a single-axle vehicle useable in urban warfare situations as well. However, the disadvantage is an unnatural swaying movement of the dummy 101 in case of sudden direction changes of the single-axle vehicle 500. Movable target 100, in this exemplary arrangement shown in FIG. 9 includes control unit 812.

Figures 10, 11, 12, 13:
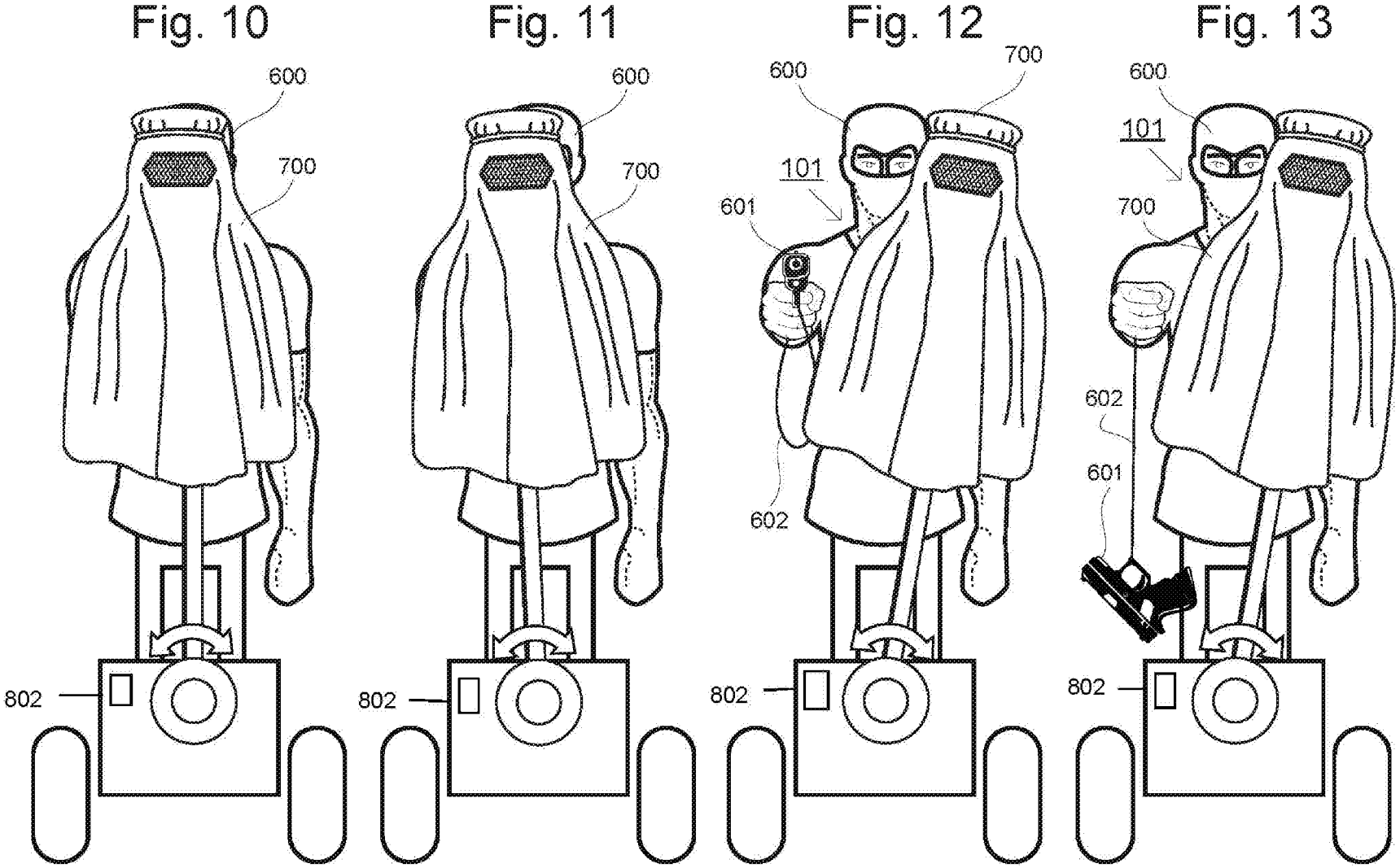

FIG. 10, FIG. 11, FIG. 12 and FIG. 13 show a typical hostage situation in a row, wherein the target person 600 portrayed by the dummy 101 uses a hostage, portrayed by the hostage dummy 700, as a human shield. The hostage dummy 700 is also referred to as a second or additional dummy. The hostage dummy or second or additional dummy 700 is movably motor driven by a drive 802 including at least one of a lever or a scissor gear. The drive 802 is operative to move the second dummy 700 to either overlap or be positioned offset to the first dummy 101. The drive 802 can be controlled remotely. In FIG. 10 the target person 600 portrayed by the dummy 101 is not visible for the sniper in training at all. The hostage dummy 700 constructed as target disk or three-dimensional shell can be moved motor driven and it can for instance swivel back and forth in front of the dummy 101 consisting of torso 102 and head 108 remotely triggered or controlled by a program. Thereby, as displayed in FIG. 11, the target person 600 portrayed by the dummy 101 might be only partially visible. Only when pivoting away, like shown in FIG. 12, it becomes discernible for the sniper in training that the target person 600 portrayed by the dummy 101 holds up a dummy weapon 601 aiming. Depending upon further circumstances, this situation would make an aimed shot on the target person 600 portrayed by the dummy 101 justifiable and possibly necessary. However, this situation in FIG. 12 changes within fractions of seconds, when the target person 600 portrayed by the dummy 101 suddenly drops the dummy weapon 601. In FIG. 13 that is shown in form of a dummy weapon 601 hanging on a halyard 602.

LIST OF REFERENCE SIGNS

| | |
|---|---|
| 10 | target |
| 11 | target |
| 12 | torso |
| 13 | vehicle |
| 100 | target |
| 100' | target |
| 100" | target |
| 101 | dummy |
| 102 | torso |
| 103 | arm |
| 104 | dummy weapon |
| 105 | sensors |
| 106 | sensors |
| 107 | grid |
| 108 | head |

-continued

| LIST OF REFERENCE SIGNS | |
|---|---|
| 113 | vehicle |
| 120 | sensor |
| 121 | sensor |
| 122 | sensor |
| 123 | sensor |
| 130 | slot |
| 135 | piezo element |
| 140 | sensor data evaluating apparatus |
| 150 | level of sagittal section |
| 150a | dummy half |
| 150b | dummy half |
| 160 | side |
| 170 | gel |
| 200 | projectile |
| 201 | tunnel |
| 210 | pressure wave |
| 300 | small vehicle |
| 301 | sensor data evaluating apparatus |
| 400 | robotic legs |
| 500 | single-axle vehicle |
| 600 | target person |
| 601 | dummy weapon |
| 700 | dummy hostage |
| A | detail enlargement |
| B | detail enlargement |
| 800 | drive |
| 802 | drive |
| 804 | body axis |
| 806 | exterior skin |
| 810 | small edge width silhouette |
| 812 | control unit |
| 814 | inner shape of buttonhole shape slots |
| 816 | outer shape of the pre-configured sensor |

The invention claimed is:

1. A target, comprising:

a dummy depicting at least one part of a human body;

wherein the dummy depicting the at least one part of the human body comprises a plurality of sensors;

wherein the plurality of sensors communicate with a sensor data evaluating apparatus for a registration of sensor data; and wherein the sensor data evaluating apparatus is operative to determine by mathematical correlation of points in time corresponding with maximum pressures from the sensor data of the plurality of sensors, the point of entry and a trajectory of a projectile penetrating the dummy.

2. The target according to claim 1, wherein the plurality of sensors are configured to communicate wirelessly with the sensor data evaluating apparatus by at least one of:

active or passive RFID transponder communication, communication by a generic near field communication with the sensor data evaluating apparatus, infrared communication, and radio communication.

3. The target according to claim 1, wherein an arm of the dummy depicting at least one part of the human body comprises:

a fixture configured to hold an object;

wherein the object is located approximately in an area of a hand mounted to the arm;

wherein the fixture can drop the object previously held by remote triggering; and wherein the fixture can be controlled remotely.

4. The target according to claim 3, wherein the arm of the dummy depicting the at least one part of the human body is movably motor driven by a drive; and wherein the drive can be controlled remotely.

5. The target according to claim 1, wherein an additional dummy depicting an additional at least one part of the human body is positioned behind or in front of the dummy on the target;

wherein the additional dummy is movably motor driven by an additional drive including at least one of:

a lever and a scissor gear;

wherein the dummy and the additional dummy can either overlap or be positioned offset to each other; and wherein the additional drive can be controlled remotely.

6. The target according to claim 1, wherein each of the plurality of sensors has a flat-shape or a disk-shape and are aligned radially in relation to a body axis of the dummy depicting the at least one part of the human body:

wherein the dummy includes an exterior skin;

wherein each of the plurality of sensors has a small edge width silhouette which extends radially into a wall of the exterior skin of the dummy;

wherein the plurality of sensors are identical among each other and are pre-configured by color and shape for an easy exchange; and wherein each of the plurality of sensors is extendable into the dummy at a point on the dummy which is predetermined.

7. The target according to claim 1, and further comprising:

a device for unbound movement across a terrain;

wherein the device supports the dummy; and wherein the device consists of:

a three-wheeled armored small vehicle, a four-wheeled armored small vehicle, a single-axle armored vehicle with two wheels arranged in parallel on one axle with a straightening apparatus, or a two-legged device resembling two human legs, whereby the two-legged device is capable of performing a humanoid motion of movement.

8. The target according to claim 3, further comprising:

a control unit present within the target that controls at least one of:

an unbound movement across a terrain, the arm of the dummy, and the fixture for the mounting of objects;

wherein the control unit is operative to cause the dummy to perform a pre-set repertoire of motion patterns, wherein the pre-set repertoire of motion patterns externally conform to body language of typical emotions during a combat situation, including at least one of:

a resting position to remain unrecognized, a position of panic, a position of aggression, and a position of flight;

wherein the control unit is wirelessly connected by a connection to additional movable targets through a central command device, wherein the connection is by at least one of:

a client-server communication, and a peer-to-peer communication;

wherein the dummy is capable of receiving a hit by the projectile with predetermined parameters, the predetermined parameters consist of:

a computed lethal shot, a computed man-stopping shot, or a computed shot lethal with delay; and wherein the control unit communicates a result by computation to additional movable targets, and the additional movable targets show a changed motion pattern responsive to the communication of the result by the control unit.

9. The target according to claim 1, wherein the dummy is compacted at an external surface comprising:

polyurethane foam, or vinyl rubber;

wherein the external surface has a rubbery or leathery consistency, wherein locations for the plurality of sensors include button-hole shape slots within the external surface of the dummy;

wherein each of the button-hole shape slots have an inner shape which corresponds to an outer shape of each of the plurality of sensors; and wherein the button-hole shape slots exhibit a colour color marking.

10. The target according to claim 1, wherein the dummy has a density which is similar to a human body density.

* * * * *